US009356716B2

(12) United States Patent
Sheikh et al.

(10) Patent No.: US 9,356,716 B2
(45) Date of Patent: May 31, 2016

(54) SYSTEM AND METHOD FOR VISUAL MESSAGE COMMUNICATION

(71) Applicant: Tata Consultancy Services Limited, Mumbai (IN)

(72) Inventors: Imran Ahmed Sheikh, Thane (IN); Sunil Kumar Kopparapu, Thane (IN)

(73) Assignee: Tata Consultancy Services Limited (IN)

( * ) Notice: Subject to any disclaimer, the term of this patent is extended or adjusted under 35 U.S.C. 154(b) by 114 days.

(21) Appl. No.: 14/213,223

(22) Filed: Mar. 14, 2014

(65) Prior Publication Data

US 2014/0287676 A1 Sep. 25, 2014

(30) Foreign Application Priority Data

Mar. 25, 2013 (IN) ..... 1116/MUM/2013

(51) Int. Cl.
*H04H 40/00* (2009.01)
*H04H 20/95* (2008.01)

(52) U.S. Cl.
CPC ..... *H04H 20/95* (2013.01)

(58) Field of Classification Search
USPC ..... 455/3.01–3.06; 382/276; 358/400
See application file for complete search history.

(56) References Cited

U.S. PATENT DOCUMENTS 6,947,180 B1 * 9/2005 Hyziak ..... H04L 12/2854 358/400
7,365,884 B2 * 4/2008 Gordon ..... H04N 1/32037 358/400
8,035,862 B2 * 10/2011 Gurevich ..... H04N 1/33323 358/3.27
2005/0179957 A1 * 8/2005 Matsuda ..... H04N 1/00427 358/400
2005/0213140 A1 * 9/2005 Suzuki ..... H04N 1/00212 358/1.15
2006/0037040 A1 2/2006 Mahalick et al.
2007/0024899 A1 * 2/2007 Henry ..... G06Q 10/107 358/1.15
2008/0165731 A1 * 7/2008 Zellner ..... H04W 72/10 370/329

FOREIGN PATENT DOCUMENTS

EP 0793878 A1 9/1997
EP 0942402 A2 8/2000
EP 1474939 A1 11/2004

* cited by examiner

*Primary Examiner* — Fayyaz Alam
(74) *Attorney, Agent, or Firm* — Finnegan, Henderson, Farabow, Garrett & Dunner, LLP

(57) ABSTRACT

The present disclosure generally relates to broadcasting and telecommunication and, more particularly, to broadcasting of text and visual messages over a geographical area. In one embodiment, a visual information broadcaster is disclosed, comprising: a hardware processor; and a memory coupled to the processor, wherein the memory comprises a plurality of modules capable of being executed by the processor to perform operations, and wherein the plurality of modules comprises: a receiving module configured to receive a first input comprising a string of characters selected from a text, an image, or a combination thereof, a transforming module configured to transform the first input into a first image having at least two dimensions; an encoder module configured to convert the first image into a one-dimensional signal waveform; and a modulator module configured to modulate the one-dimensional signal waveform for transmission via a modulated one-dimensional signal waveform.

10 Claims, 6 Drawing Sheets

SYSTEM AND METHOD FOR VISUAL MESSAGE COMMUNICATION

PRIORITY CLAIM

This U.S. patent application claims priority under 35 U.S.C. §119 to India Application No. 1116/MUM/2013, filed Mar. 25, 2013. The aforementioned application is incorporated herein by reference in its entirety.

TECHNICAL FIELD

The present disclosure described herein, in general, relates to broadcasting and telecommunication and, more particularly, to broadcasting of text and visual messages over a desired geographical area.

BACKGROUND

Broadcasting is a well-known and well-received method of communication for transfer of information. Broadcasting enables transfer of both audio and visual information, depending upon the need and capability of the broadcaster.

Conventionally, frequency modulation (FM) or amplitude modulation (AM) has been used to broadcast audio information over a wide geographical region. FM or AM channels for broadcast are limited in that only audio signals can be transmitted. Audio signals as information or entertainment have a temporary effect on the listener's memory. Further, the temporary information may impose a cognitive load on the listener's memory. To reduce the temporary effect of audio signals on the listener's memory, audio signals may be combined with visual signals as in the case of television broadcasting, though separate channels are needed for broadcasting the audio and visual signals.

Another method of broadcasting information is Cell Broadcast (CB) for mobile phones, however CB is restricted to certain text-only types of broadcast, thereby limiting its usability. Another method for broadcasting to cell phones is Bluetooth™, but that method has security restrictions, as well as timing and visibility constraints, thereby rendering the technology ineffective to achieve maximum penetration in a given locality.

SUMMARY

This summary is provided to introduce aspects related to methods and systems for transmitting visual information wherein such aspects are further described below in the detailed description. This summary is not intended to identify essential features of the claimed subject matter nor is it intended for use in determining or limiting the scope of the claimed subject matter.

In one embodiment, a processor-implemented visual information broadcast method is disclosed, comprising: receiving, a first input, wherein the first input comprises a string of characters selected from a text, or an image, or a combination thereof; transforming the first input from the strings of characters to a first image wherein the first image has at least two dimensions; converting the first image into a one-dimensional signal waveform; modulating the one-dimensional signal waveform to generate a modulated one-dimensional signal waveform; and transmitting the modulated one-dimensional signal waveform over a radio channel configured to transmit audio signals; wherein at least one of the receiving, the transforming, the converting, the modulating and the transmitting is performed by one or more hardware processors.

In one embodiment, a visual broadcast information extraction method is disclosed, comprising: capturing a modulated one-dimensional signal waveform transmitted over a radio channel configured to transmit audio signals; demodulating the modulated one-dimensional signal waveform into a one-dimensional signal waveform; converting the one-dimensional signal waveform into a first image representing a string of characters selected from a text, image, or combination thereof, wherein the first image has at least two dimensions; and displaying the first image on a recipient device; wherein at least one of the capturing, the demodulating, the identifying, the converting and the displaying is performed by one or more hardware processors.

In one embodiment, a visual information broadcaster is disclosed, the broadcaster comprising: a hardware processor and a memory coupled to the processor comprising a plurality of modules capable of being executed by the processor. The plurality of modules may comprise: a receiving module configured to receive a first input, wherein the first input comprises a string of characters selected from a text, or an image, or a combination thereof, a transforming module configured to transform the first input into a first image having at least two dimensions; an encoder module configured to convert the first image into a one-dimensional signal waveform; and a modulator module configured to modulate the one-dimensional signal waveform for transmission via a modulated one-dimensional signal waveform.

In one embodiment, a recipient device configured to extract visual information broadcast transmitted over a radio channel for transmitting audio signals is disclosed, the recipient device comprising: a hardware processor, an Input/output (I/O) interface coupled to the processor, and a memory coupled to the processor comprising a plurality of modules capable of being executed by the processor. The plurality of modules may comprise: a capturing module configured to capture a modulated one-dimensional signal waveform transmitted over a radio channel; a demodulating module configured to demodulate the modulated one-dimensional signal waveform into a one-dimensional signal waveform; a decoder module configured to decode the one-dimensional signal waveform into a first image based on a header chunk identified by the decoder module; and a display module configured to display a first input represented as the first image.

BRIEF DESCRIPTION OF THE DRAWINGS

The accompanying drawings, which are incorporated in and constitute a part of this disclosure, illustrate exemplary embodiments and, together with the description, serve to explain the disclosed principles. In the figures, the left-most digit(s) of a reference number identifies the figure in which the reference number first appears. The same numbers are used throughout the drawings to refer like features and components.

DETAILED DESCRIPTION

Figure 1:
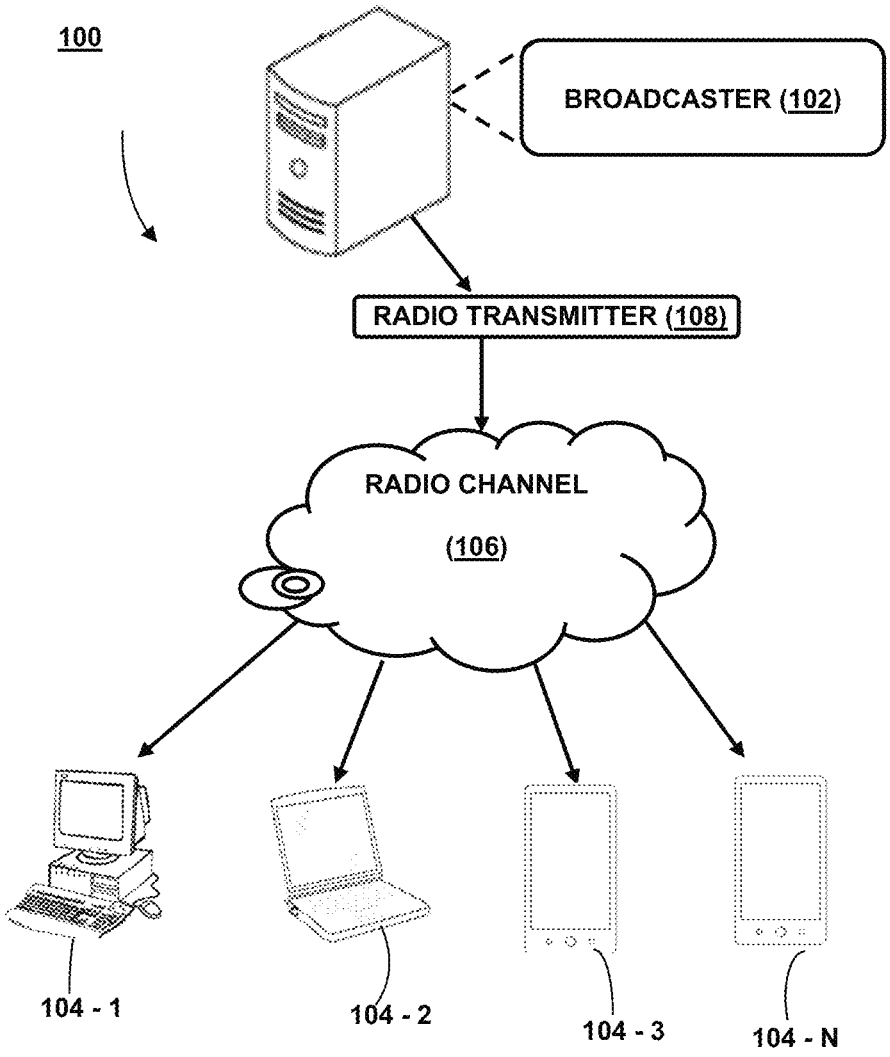
FIG. 1 illustrates a system for visual information broadcast in accordance with an embodiment of the present subject matter.

System and method for broadcasting visual information are disclosed. The present subject matter enables a broadcaster to broadcast information captured from a text or an image to the recipient device in an image form.

Specifically, embodiments of the disclosure may enable broadcasting of visual information at the recipient device, wherein the recipient device can include stationary or portable computing processor, in a given locality or desired geographical region. The disclosure, in one embodiment, may use a Frequency Modulated (FM) radio channel or Amplitude Modulated (AM) radio channel for broadcasting visual messages to the recipient device having a radio receiver. The embodiment may enable transmission of the visual information on the radio channel, wherein the radio channel is configured to transmit audio signals. An audio signal may be generated wherein the audio signal represents the visual message intended to be broadcasted over the radio channel. The visual messages may be embedded in the audio signal. The radio broadcast signal may be captured by the recipient device configured to receive the radio signals. The recipient device may extract the audio signal comprising the visual message from the radio signal.

Embodiments of system according to present disclosure may comprise two components, the broadcaster and the recipient device. The broadcaster may include a stationary or mobile computing processor, or an application hosted on the cloud or on a server, or connected to a server, or a combination thereof. The broadcaster may transmit the visual information desired by a user in a desired locality. The broadcaster may encode and broadcast the visual/text message over the radio channel. The broadcaster may convert an input text or visual message or combination thereof, received from the user, into a two-dimensional image. The two dimensions of the two-dimensional image can be width and length. The two-dimensional (2D) image may be converted to a one-dimensional (1D) signal waveform by the broadcaster. The radio channel may be capable of transmitting only audio signals; therefore the visual information may be converted, or embedded, into the audio signal waveform. The converted signal waveform may then be transmitted in the locality using a radio transmitter over the desired channel frequency. The frequency or amplitude of the signal waveform may be modulated in order to transmit the signal waveform over the radio channel.

According to an embodiment of the present disclosure, the two-dimensional image may be converted to one-dimensional signal waveform in the following way: The two-dimensional image can be read along with one of its dimension that is either the length or the width. Using a pixel to sample encoding scheme the two-dimensional image is converted into the one-dimensional signal waveform. A header chunk may be created at the beginning of the one-dimensional signal waveform to address issues that may otherwise arise; for e.g., varying number of pixels, and/or number of rows/columns for images of different sizes. In one embodiment, the header chunk may be of a fixed size and may contain sample values that correspond to the number of rows and columns and additional meta information about the two-dimensional image.

The recipient device according to the present disclosure may receive the radio broadcast from the broadcaster, decode the signal, and display the two-dimensional image on the recipient device. The recipient device may demodulate the audio signal to obtain one-dimensional signal waveform, and further decode the one-dimensional signal waveform back into the two-dimensional image. According to an embodiment, the one-dimensional signal waveform may be converted to two-dimensional images in following way: The header chunk generated in the broadcaster may be identified in the one-dimensional signal waveform so received. Samples representing the two-dimensional waveform based on the header chunk may be converted into pixels by using the sample to pixel decoding scheme which may then be displayed on the recipient device.

Referring now to FIG. 1, a system 100 for visual information broadcast is presented. The system for visual information broadcast may comprise a broadcaster 102, wherein the broadcaster may include a stationary or mobile computing processor, or an application hosted on the cloud or on a server, or connected to a server, or a combination thereof. The broadcaster 102 may be coupled to radio transmitter 108 through a network (not shown). The radio transmitter 108 may be configured to transmit radio signals over a variety frequency and channels; for e.g., on an FM channel wherein said frequency can vary between 87 MHz to 107 MHz. The broadcaster 102 may determine which channel or frequency to use for broadcasting the visual information. The radio transmitter 108, according to an embodiment of the present disclosure, may transmit the visual information over a radio channel 106, wherein the radio channel 106 may be configured to transmit audio signal. The visual information embedded in the audio signal transmitted over the radio channel 106 may be then captured by one or more recipient device(s) 104-1, 104-2, . . . , 104-N.

The recipient device(s) 104-1, 104-2, . . . , 104-N may include stationary or mobile computing processors. The recipient device(s) 104 may be configured to capture the visual information and further display or render the visual information onto the recipient device(s) 104, wherein the recipient device(s) may be assumed to be operating in the desired locality or geographic region.

Figure 2:
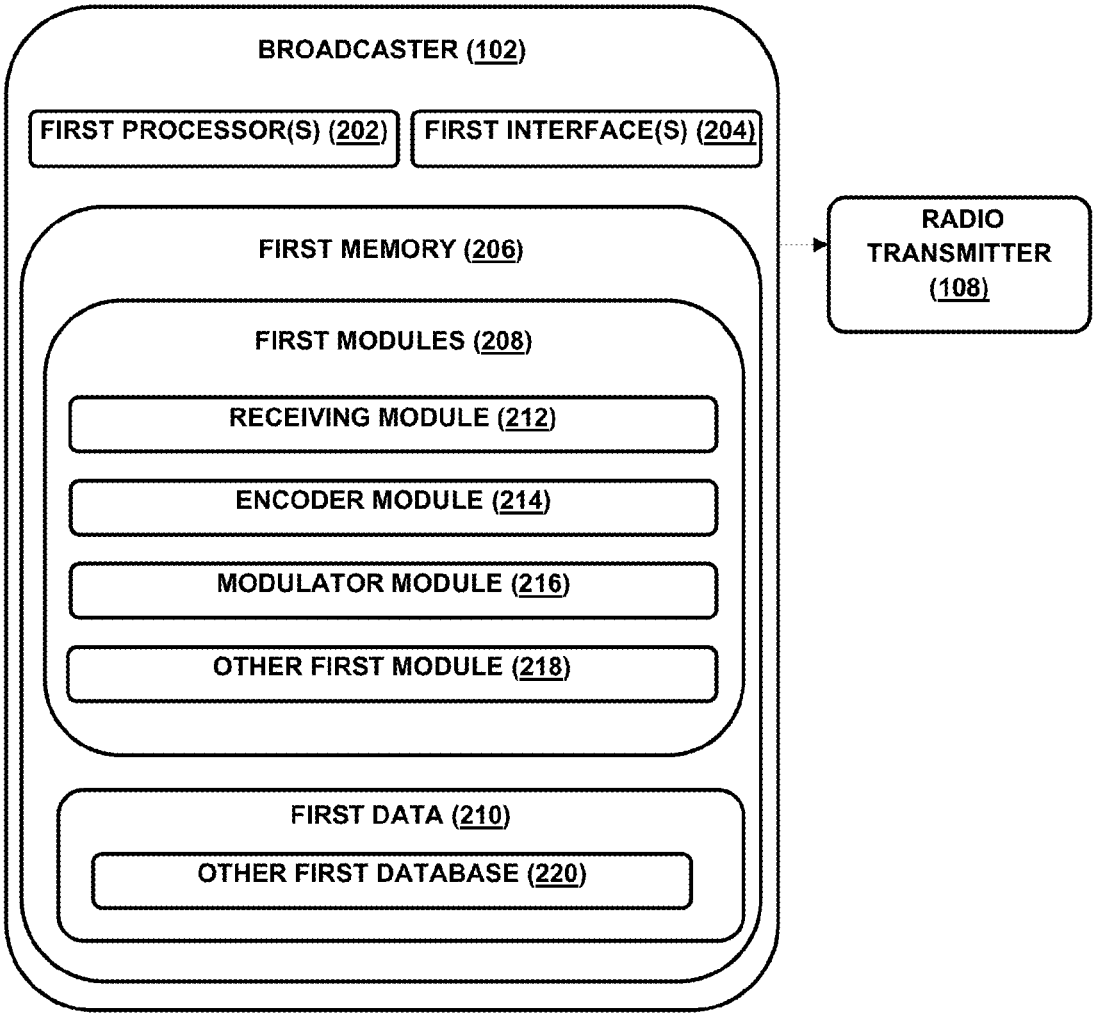
FIG. 2, a broadcaster is illustrated in accordance with an embodiment of the present subject matter.

Referring now to FIG. 2, the broadcaster 102 is illustrated in accordance with an embodiment of the present subject matter. In one embodiment, the broadcaster 102 may include at least one first processor 202, a first input/output (I/O) interface 204, and a first memory 206. The at least one first processor 202 may be implemented as one or more microprocessors, microcomputers, microcontrollers, digital signal processors, central processing units, state machines, logic circuitries, and/or any devices that manipulate signals based on operational instructions. Among other capabilities, the at least one first processor 202 may be configured to fetch and execute computer-readable instructions stored in the first memory 206.

The I/O interface 204 may include a variety of software and hardware interfaces, for example, a web interface, a graphical user interface, and the like. The I/O interface 204 may allow the broadcaster 102 to interact with a radio transmitter 108. The I/O interface 204, may further enable the broadcaster 102 to communicate with other computing devices, such as web servers or external data servers (not shown) via a communication network (not shown). The I/O interface 204 can facilitate multiple communications within a wide variety of networks and protocol types, including wired networks, for example, LAN, cable, etc., and wireless networks, such as WLAN, cellular, or satellite. The I/O interface 204 may include one or more ports for connecting a number of devices to one another or to another server.

The first memory 206 may include any computer-readable medium known in the art including, for example, volatile memory like static random access memory (SRAM) and dynamic random access memory (DRAM), and/or non-volatile memory, such as read only memory (ROM), erasable programmable ROM, flash memories, hard disks, optical disks, and magnetic tapes. The first memory 206 may include first modules 208 and first data 210. The first modules 208 include routines, programs, objects, components, data structures, etc., which perform particular tasks or implement particular abstract data types. In one implementation, the modules 208 may include a receiving module 212, an encoder module 214, modulator module 216 and other first modules 218. The other first modules 218 may include programs or coded instructions that supplement applications and functions of the broadcaster 102.

The first data 210, amongst other things, serves as a repository for storing data processed, received, and generated by one or more of the first modules 208. The first data 210 may also include other first database 220. The other first database 220 may include data generated as a result of the execution of one or more modules in the other first module 218.

In one embodiment, the receiving module 212 of the broadcaster 102 receives a first input, wherein the first input may comprise of a string of characters. The string of characters may be selected from a text, or an image, or a combination thereof. The text or image or a combination thereof may be received using the first Input/Output (I/O) interface (204). The first input is transformed into a first image having at least two dimensions. The first image may also be called as two-dimensional image that may comprise of at least two dimensions representing corresponding width and length thereof The first image may further be converted into a one-dimensional signal waveform by the encoder module 214. The encoder module 214 may use a pixel to sample encoder to convert the first image into the one-dimensional signal waveform, wherein the pixel to sample encoder may process the first image along either of the at least two dimension i.e. either along the width or the length of the first image. For e.g., each row/width of the first image may be converted into one-dimensional signal waveform by using a pixel to sample encoding scheme. The successive rows/width thereon may be continuously converted into one-dimensional signal waveform and appended to the one-dimensional signal waveform created from previous rows in order to create a long one-dimensional signal waveform. Similarly, each column/length may be converted into a long one-dimensional signal waveform, the one-dimensional signal waveform so generated from each successive column/length can then be continuously appended to the previously converted column/length.

The encoder module 214 may embed a header chunk into the one-dimensional signal waveform. The header chunk may comprise values corresponding either of the at least two dimension, or a meta information pertaining to the first image, or combination thereof.

The one-dimensional waveform may have a frequency that may be determined by the pixel to sample encoder. The one-dimensional waveform may be further modulated into a modulated one-dimensional signal waveform using the modulator module 216 for transmission using a carrier frequency. The modulated one-dimensional signal waveform may be transmitted over the radio channel 106 using the radio transmitter 108. The modulated one-dimensional signal waveform may be captured by the recipient device 104.

Figure 3:
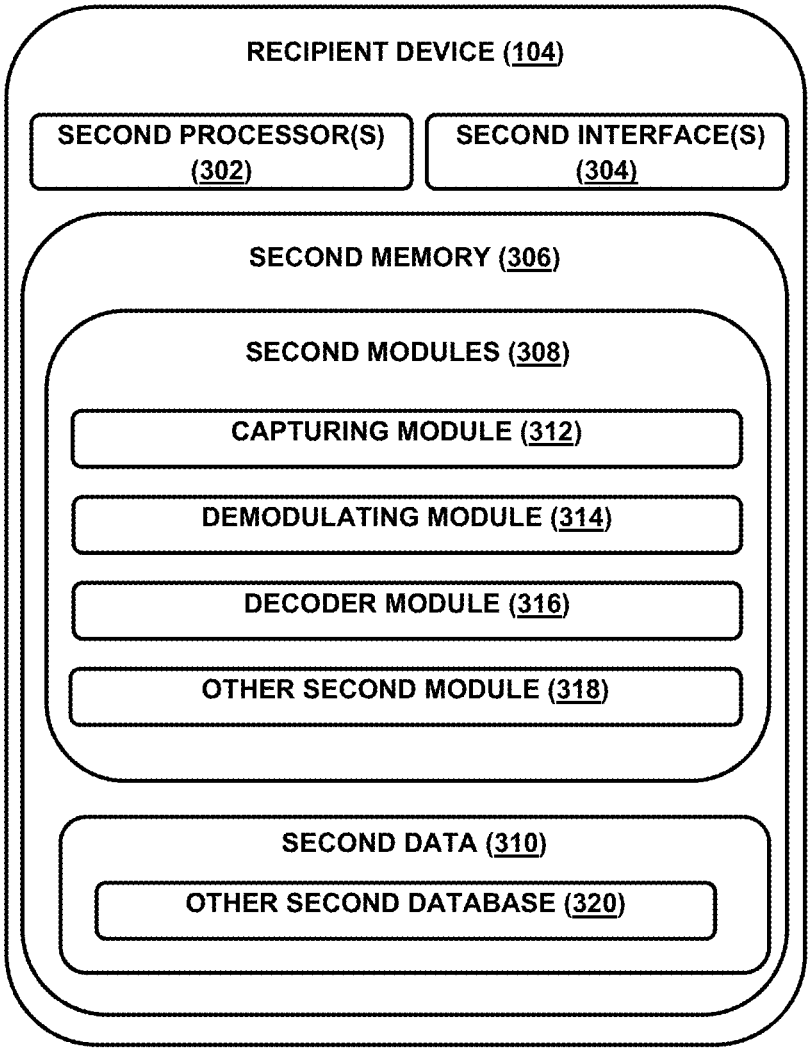
FIG. 3, a recipient device is illustrated according to an embodiment of the present disclosure.

Referring now to FIG. 3, the recipient device 104 is illustrated according to an embodiment of the present disclosure. The recipient device 104 may include at least one second processor 302, a second input/output (I/O) interface 304, and a second memory 306. The at least one second processor 302 may be implemented as one or more microprocessors, microcomputers, microcontrollers, digital signal processors, central processing units, state machines, logic circuitries, and/or any devices that manipulate signals based on operational instructions. Among other capabilities, the at least one second processor 302 may be configured to fetch and execute computer-readable instructions stored in the second memory 306.

The second I/O interface 304 may include a variety of software and hardware interfaces, for example, a web interface, a graphical user interface, and the like. The second I/O interface 304 may further enable the recipient device 104 to communicate with other devices, such as web servers and external data servers (not shown) through communication network (not shown). The second I/O interface 304 can facilitate multiple communications within a wide variety of networks and protocol types, including wired networks, for example, LAN, cable, etc., and wireless networks, such as WLAN, cellular, or satellite. The second I/O interface 304 may include one or more ports for connecting a number of devices to one another or to another server.

The second memory 306 may include any computer-readable medium known in the art including, for example, volatile memory, such as static random access memory (SRAM) and dynamic random access memory (DRAM), and/or non-volatile memory, such as read only memory (ROM), erasable programmable ROM, flash memories, hard disks, optical disks, and magnetic tapes. The second memory 306 may include second modules 308 and second data 310.

The second modules 308 include routines, programs, objects, components, data structures, etc., which may perform particular tasks or implement particular abstract data types. In one implementation, the second modules 308 may include a capturing module 312, a demodulating module 314, a decoder module 316 and other second modules 318. The other second modules 318 may include programs or coded instructions that supplement applications and functions of the recipient device 104.

The second data 310, amongst other things, may serve as a repository for storing data processed, received, and generated by one or more of the second modules 308. The second data 310 may also include other second database 320. The other second database 320 may include data generated as a result of the execution of one or more modules in the other second module 318.

The capturing module 312, may capture the modulated one-dimensional signal waveform. The modulated one-dimensional signal waveform may be relayed over the radio channel. The captured modulated one-dimensional signal waveform can be demodulated using the demodulating module 314. The demodulating module 314 may demodulate the modulated one-dimensional signal waveform to the one-dimensional signal waveform. The decode module 316 may further decode the one-dimensional signal waveform and convert it into the first image by identifying the header chunk. The samples following the header chunk may be converted into pixels wherein a sample to pixel decoding scheme may be used. Further a display module like the second Input/Output (I/O) interface 304 may be used to display a first input represented as the first image onto the recipient device 104.

Figure 4:
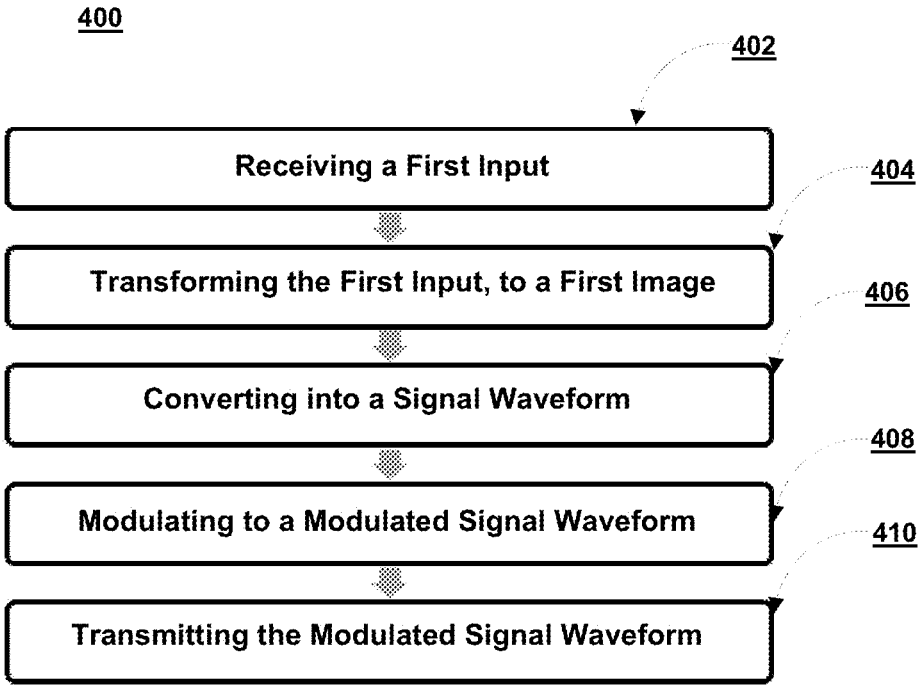
FIG. 4, is a flowchart illustrating a method for transmitting a visual information broadcast, in accordance with an embodiment of the present subject matter.

FIG. 4 is a flowchart illustrating an exemplary method for transmitting a visual information broadcast, in accordance with an embodiment of the present subject matter. The order in which the method 400 is described is not intended to be construed as a limitation, and any number of the described method blocks can be combined in any order to implement the method 400 or alternate methods. Additionally, individual blocks may be deleted from the method 400 without departing from the spirit and scope of the subject matter described herein. Furthermore, the method can be implemented in any suitable hardware, software, firmware, or combination thereof. However, for ease of explanation, in the embodiments described below, the method 400 may be considered to be implemented in the above described broadcaster 102.

At block 402, a first input may be received. The first input may comprise a string of characters selected from a text, or an image or a combination thereof. At block 404, the first input may be transformed from the strings of characters to a first image. The first image may have at least two dimensions, the at least two dimension may represent width and length of the first image. At block 406, the first image may be converted into a one-dimensional signal waveform. The conversion of the first image into one-dimensional signal waveform, may comprise processing the first image along either of the at least two dimensions of the first image and converting the first image into the one-dimensional signal waveform using a pixel to sample encoder.

At block 408, the one-dimensional signal waveform may be modulated to a modulated one-dimensional signal waveform, using a modulator. The modulated one-dimensional signal waveform may be transmitted by block 410 over a radio channel, wherein the radio channel may be configured to transmit audio signal.

Figure 5:
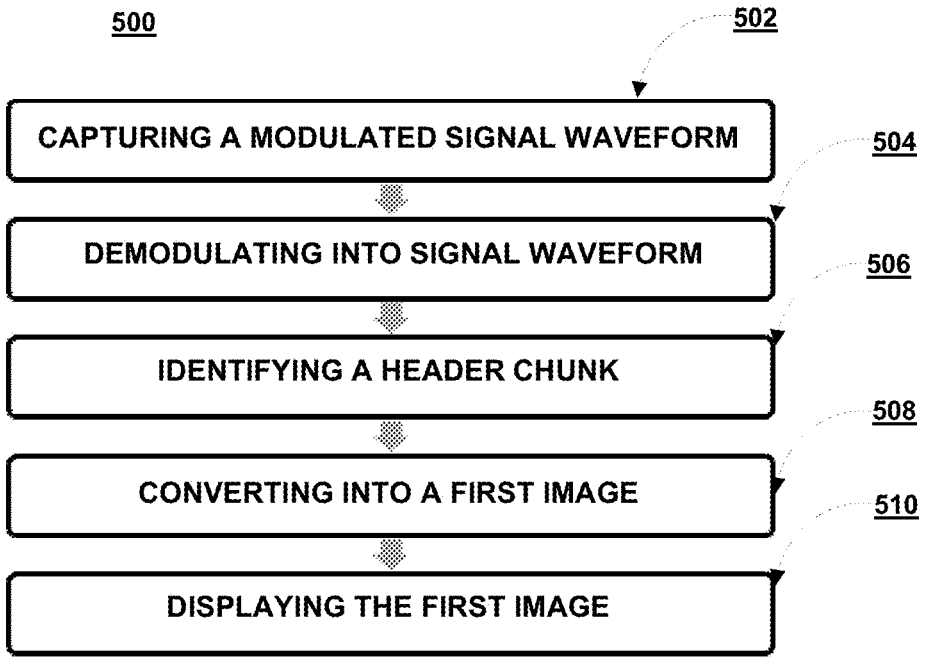
FIG. 5, is a flowchart illustrating a method for extracting a visual information broadcast, in accordance with an embodiment of the present subject matter.

FIG. 5 is a flowchart illustrating an exemplary method for extracting a visual information broadcast, in accordance with an embodiment of the present subject matter. The order in which the method 500 is described is not intended to be construed as a limitation, and any number of the described method blocks can be combined in any order to implement the method 500 or alternate methods. Additionally, individual blocks may be deleted from the method 500 without departing from the spirit and scope of the subject matter described herein. Furthermore, the method can be implemented in any suitable hardware, software, firmware, or combination thereof. However, for ease of explanation, in the embodiments described below, the method 500 may be considered to be implemented in the above described recipient device 104.

At block 502, the modulated one-dimensional signal waveform may be captured. At block 504, the modulated one-dimensional signal waveform may be demodulated to the one-dimensional signal waveform. At block 506, the header chunk embedded in the one-dimensional signal waveform may be identified in order to convert the one-dimensional signal waveform into the first image. At block 508, the one-dimensional signal waveform may be converted into the first image using the sample to pixel decoder. The first image may have at least two dimensions. At block 510 the first image may be rendered or displayed on the recipient device 104.

Figure 6:
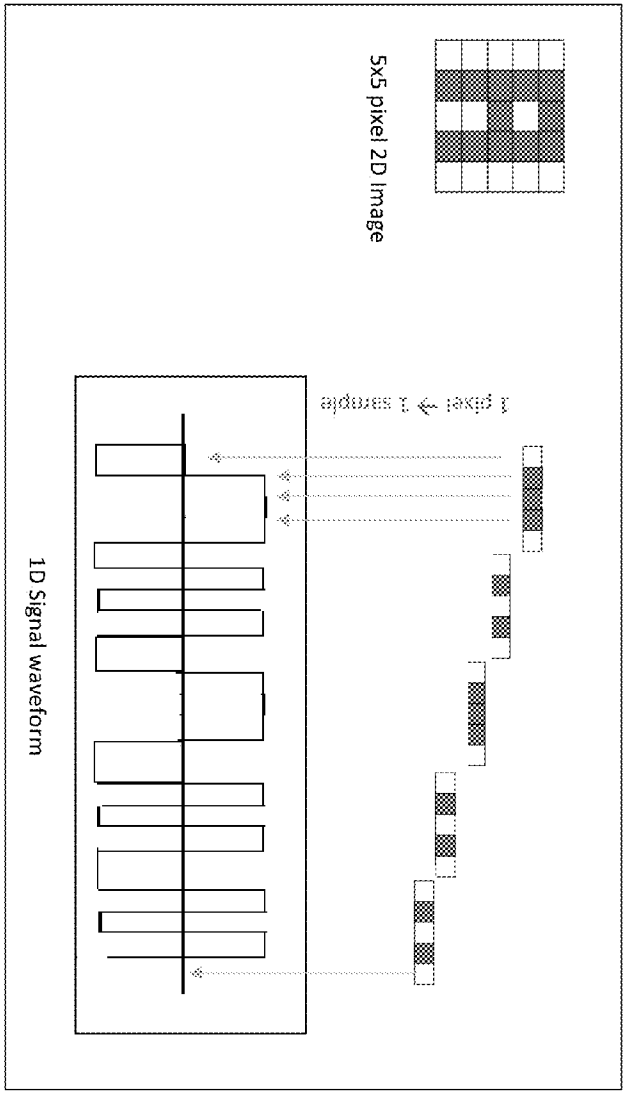
FIG. 6, illustrates an example of pixel to sample encoding schemes according to an embodiment of the present subject matter.

FIG. 6, illustrates an example of pixel to sample encoding schemes according to an embodiment of the present subject matter. The illustration shall not be construed as the only pixel to sample encoding schemes that can be used for the present disclosure. The first image with at least two dimensions may be assumed to be a monochrome image. Each pixel of the monochrome image may be encoded into one-dimensional signal waveform. Each pixel can be represented by 1 bit (1 for white and 0 for black) and in cases when the monochrome images has shades of gray, each pixel may be represented by more than one bit; generally 8 bit (byte) or 16 bit (word).

We claim:

1. A processor-implemented method for transmitting visual information, the method comprising;

receiving a first input comprising a string of characters selected from at least one of a text, an image, or a combination thereof;

transforming, by one or more processors, the first input from the strings of characters to a first image having at least two dimensions;

converting, by the one or more processors, the first image into a one-dimensional signal waveform using a pixel to sample encoder, wherein the pixel to sample encoder processes the first image along either of the at least two dimensions;

modulating, by the one or more processors, the one-dimensional signal waveform to generate a modulated one-dimensional signal waveform; and transmitting the modulated one-dimensional signal waveform over a radio channel configured to transmit audio signals.

2. The method of claim 1, further comprising:

creating a header chunk subsequent to conversion of the first image into the one-dimensional signal waveform;

wherein the header chunk comprises values corresponding to: the at least two dimensions, a meta information pertaining to the strings of characters, or a combination thereof.

3. The method of claim 1, further comprising:

transmitting the modulated one-dimensional signal waveform to a recipient device to display the one-dimensional signal waveform.

4. A processor-implemented method for extracting visual information, the method comprising:

capturing a modulated one-dimensional signal waveform transmitted over a radio channel configured to transmit audio signals;

demodulating the modulated one-dimensional signal waveform into a one-dimensional signal waveform;

converting, by one or more processors, the one-dimensional signal waveform into a first image using a sample to pixel decoder and a header chunk, wherein the first image represents a string of characters selected from a text, image, or combination thereof, and has at least two dimensions; and displaying the first image on a recipient device.

5. A broadcaster for transmitting visual information, the broadcaster comprising:

a hardware processor;

and a memory coupled to the processor, wherein the memory comprises a plurality of modules capable of being executed by the processor to perform operations, the plurality of modules comprising:

a receiving module configured to receive a first input comprising a string of characters selected from a text, an image, or a combination thereof, a transforming module configured to transform the first input into a first image having at least two dimensions;

an encoder module configured to convert the first image into a one-dimensional signal waveform using a pixel to sample encoder, wherein the pixel to sample encoder processes the first image alone either of the at least two dimension; and a modulator module configured to modulate the one-dimensional signal waveform to generate a modulated one-dimensional signal waveform.

6. The broadcaster of claim 5, further comprising a radio transmitter configured to transmit the modulated one-dimensional signal waveform over a radio channel configured to transmit audio signals.

7. The broadcaster of claim 5, wherein the encoder module further embeds a header chunk into the one-dimensional signal waveform, wherein the header chunk comprises values corresponding to: the at least two dimensions, meta information pertaining to the first image, or a combination thereof.

8. The broadcaster of claim 6, wherein the radio transmitter is configured to transmit the modulated one-dimensional signal waveform to a recipient device configured to display the first input.

9. A recipient device configured to extract visual information transmitted over a radio channel for transmitting audio signals, the recipient device comprising:

a hardware processor;

and a memory coupled to the processor, wherein the memory comprises a plurality of modules capable of being executed by the processor to perform operations, the plurality of modules comprising:

a capturing module configured to capture a modulated one-dimensional signal waveform transmitted over a radio channel;

a demodulating module configured to demodulate the modulated one-dimensional signal waveform into a one-dimensional signal waveform;

a decoder module configured to decode the one-dimensional signal waveform into a first image using a sample to pixel decoding scheme and based on a header chunk identified by the decoder module, and wherein the first image represents a string of characters selected from at least one of a text, image, or combination thereof, and has at least two dimensions; and a display module configured to display a first input represented as the first image.

10. The method of claim 4, wherein the header chunk is identified from the one-dimensional signal waveform, and the header chunk further comprises values corresponding either of the at least two dimension, or a meta information pertaining to the first image, or combination thereof.

* * * * *